United States Patent [19]

Belopolsky

[11] Patent Number: 4,503,418

[45] Date of Patent: Mar. 5, 1985

[54] THICK FILM RESISTOR

[75] Inventor: Yakov Belopolsky, Ontario, Canada

[73] Assignee: Northern Telecom Limited, Montreal, Canada

[21] Appl. No.: 549,063

[22] Filed: Nov. 7, 1983

[51] Int. Cl.[3] ..... H01C 1/012

[52] U.S. Cl. ..... 338/309; 219/543; 29/620; 338/32 R; 338/61; 338/308; 338/314; 338/320; 338/330; 427/96

[58] Field of Search ..... 219/543; 338/61, 62, 338/63, 195, 307, 308, 309, 312, 313, 314, 320, 323, 328, 330, 32 R; 29/620, 621; 427/96; 428/213

[56] References Cited

U.S. PATENT DOCUMENTS

| | | | |
|---|---|---|---|
| 3,390,453 | 7/1968 | Riddle | 29/620 |
| 3,573,703 | 4/1971 | Burks et al. | 338/309 |
| 3,668,600 | 6/1972 | Schuberth et al. | 338/320 |
| 3,787,965 | 1/1974 | Cocca et al. | 29/620 |
| 3,889,223 | 6/1975 | Sella et al. | 338/195 |
| 3,928,836 | 12/1975 | Makino et al. | 338/32 R |
| 3,928,837 | 12/1975 | Esper et al. | 338/308 X |
| 3,947,801 | 3/1976 | Bube | 338/305 |
| 3,949,345 | 4/1976 | Makino et al. | 338/32 R |
| 3,949,346 | 4/1976 | Makino et al. | 338/32 R |
| 4,097,988 | 7/1978 | Hauschild | 29/620 |
| 4,140,817 | 2/1979 | Brown | 427/96 |
| 4,174,513 | 11/1979 | Wellard | 338/312 |
| 4,196,411 | 4/1980 | Kaufman | 338/314 |
| 4,197,521 | 4/1980 | Rovnyak | 338/314 X |
| 4,204,187 | 5/1980 | Kakuhashi et al. | 338/314 X |
| 4,293,839 | 10/1981 | Asada et al. | 338/309 |
| 4,307,373 | 12/1981 | Johnston | 338/309 X |
| 4,320,165 | 3/1982 | Cash | 428/213 |

FOREIGN PATENT DOCUMENTS

| | | | |
|---|---|---|---|
| 838928 | 3/1939 | France | 338/61 |
| 2088644 | 6/1982 | United Kingdom | 338/308 |

*Primary Examiner*—Volodymyr Y. Mayewsky
*Attorney, Agent, or Firm*—Robert C. Hogeboom

[57] ABSTRACT

A novel construction for a thick film resistor is disclosed. A substrate has a first face deposited with a layer of resistive material. Between the substrate and this first layer is located a strip of conductive material. The strip of material is oriented at approximately right angles to the current path through the first layer, midway along the current path. A second layer of resistive material is located on a second face, parallel to the first face, and the first and second layers are connected electrically in series such that the current path through the second layer is orthogonal to the current path through the first layer.

4 Claims, 2 Drawing Figures

THICK FILM RESISTOR

BACKGROUND OF THE INVENTION

This invention relates generally to thick film resistors and more particularly to a novel construction of a thick film resistor.

Thick film resistors are well known and are commonly formed by applying a paste of a resistive material onto an insulating substrate; the applied resistive material is then dried and hardened by the application of heat. The magnitude of the resistance of such a resistor depends upon the thickness of the resistive material, the composition of the material, and upon the extent of the area of the substrate covered with the resistive material.

One application of thick film resistors is as battery feed resistors in battery feed circuits for telephones. In such an application a source of power (e.g. a battery) is connected to a balanced two-wire subscriber telephone line (sometimes referred to as a loop) via two battery feed resistors in order to provide current to the line. The two battery feed resistors should be closely matched to each other in order to maintain the balance of the line, and are preferably small in physical size. The battery feed resistors should also be able to limit current on extremely short loops to safe values; at the same time they must be capable of carrying large currents that may arise from fault conditions (e.g. current surges due to lightning).

The following U.S. patents describe some of the known thick film resistor designs and attention is directed to them. U.S. Pat. Nos. 4,293,839 dated Oct. 6, 1981 by E. Asada et al.; 4,140,817 dated Feb. 20, 1979 by J. F. Brown; 4,097,988 dated July 4, 1978 by F. Hauschild; 3,947,801 dated Mar. 30, 1976 by K. R. Bube; 3,889,223 dated June 10, 1975 by L. Sella et al.; 3,787,956 dated Jan. 29, 1974 by T. F. Cocca et al.; and 3,573,703 dated Apr. 6, 1971 by D. P. Burks et al.

SUMMARY OF THE INVENTION

The present invention relates to a novel and improved construction for a thick film resistor. In more detail, the resistor of the present invention is comprised of two resistive portions, spaced on opposite sides of a substrate and connected in series such that the direction of the current through the one portion is at right angles to the direction of the current through the other portion. In the preferred embodiment, one of the portions of resistive material additionally includes a strip of conductive material located on the substrate, but beneath the resistive material itself, and situated approximately midway between the end electrodes that connect to the resistive material.

Stated in other terms, the present invention is a thick film resistor comprising: an electrically insulating substrate having at least a first face and a second face that are approximately parallel to one another; a first layer of resistive material deposited on the first face; a strip of electrically conductive material located on the first face, between the substrate and the first layer, the strip oriented at approximately right angles to the current path through the first layer, the strip situated approximately midway along the current path of the first layer, and the strip being of sufficient length to intercept substantially the whole of the current path through the first layer; a second layer of resistive material deposited to the second face and connected in series with the first layer in such a fashion that the current path through the second layer is approximately orthogonal to the current path through the first layer.

BRIEF DESCRIPTION OF THE DRAWINGS

The invention will now be described in more detail with reference to the accompanying drawings, wherein like parts in each of the several figures are identified by the same reference character, and wherein.

DETAILED DESCRIPTION

Figure 1:
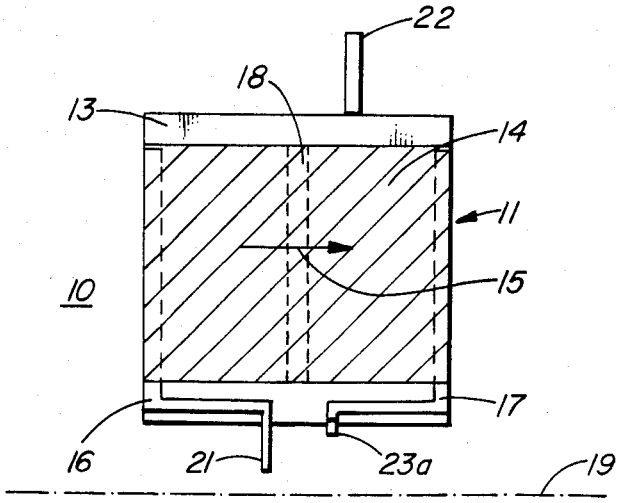
FIG. 1 is a plan view of one face of a resistor constructed according to the present invention.
Figure 2:
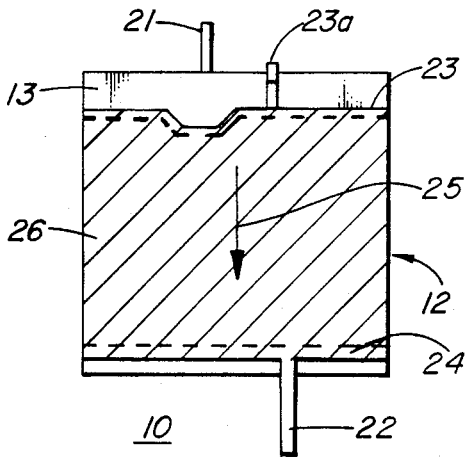
FIG. 2 is a plan view of the opposite face of the resistor shown in FIG. 1.

FIG. 1 depicts face 11 of resistor 10. Resistor 10 is comprised of a solid rectangular ceramic substrate 13 having two opposite and parallel faces indicated as 11 (FIG. 1) and 12 (FIG. 2). In the exemplary embodiment of FIGS. 1 and 2, substrate 13 is approximately 0.8 inches by 0.8 inches and is approximately 0.13 inches thick. Substrate 13 has, deposited on its face 11, a layer 14 of a resistive material. It contains an electrode 16, depicted on the left side, an electrode 17, on the right side, and an electrode 18, situated approximately midway between the electrodes 16 and 17. It should be noted that electrodes 16, 17, and 18 are fixed directly to face 11 of substrate 13 and layer 14 of resistive material is located on top of the electrodes 16, 17, and 18.

The electrodes 16, 17, and 18 make an electrical connection with resistive layer 14. Electrode 16 is used to connect to terminal 21 of resistor 10; electrode 17 is used to make an interconnection with electrode 23 and consequently with resistive layer 26 on the opposite side of substrate 13 (see FIG. 2); and electrode 18 is not used to make an electrical connection with anything other than layer 14 itself. As a result, the current path in layer 14 is as indicated by arrow 15 (or the reverse direction).

FIG. 2 depicts the opposite face (i.e. face 12) of substrate 13 from face 11 shown in FIG. 1. Note that the view in FIG. 2 is obtained by rotating resistor 10, as it is depicted in FIG. 1, 180° about axis 19. Face 12 of substrate 13 carries two electrodes 23 and 24 and a layer 26 of resistive material between electrodes 23 and 24 and overlapping them so as to make good electrical contact therewith. As a result, the current path in layer 26 is as indicated by arrow 25 (or the reverse direction).

Electrode 23 is connected electrically to electrode 17 by conductor **23*a* which straddles face 11 and face 12 of substrate 13. Electrode 24 is used to connect to terminal 22 of resistor 10**.

Consequently, it can be seen that resistor 10 is a two terminal device; the two terminals being indicated by the reference characters 21 and 22. It can also be seen that the current flow across face 11 is at right angles to the current flow across face 12. If a source of direct current is applied across terminals 21 and 22 then the current flow across face 11 is from left to right (or vice versa) in FIG. 1 as indicated by arrow 15, and the current flow across face 12 is as indicated by arrow 25 (or vice-versa). This occurs since the current path is from terminal 21 to electrode 16, to resistive layer 14 to electrode 17, to conductor **23*a*, to electrode 23, to resistive layer 26, to electrode 24, and finally to terminal 22**.

It is speculated that current flow across a thick film resistor, in particular high currents arising due to fault conditions, creates temperatures that are substantially higher than the temperature of the substrate. Such high temperature areas, commonly referred to as "hot-spots", tend to be confined to approximately the centres of the resistors. The resultant temperature gradients and consequent mechanical stresses may cause resistivity drift and damage to the resistive layer and substrate.

It is further speculated that having the currents flowing at right angles to each other, on opposite faces of resistor 10, helps to confine the area of potentially higher temperature to approximately the location of electrode 18. Electrode 18, however, being of conductive material has electrical and thermal conductivities substantially higher than that of the resistive layer 14 so that the power dissipated in the area of electrode 18 is low in comparison to adjacent regions. The resultant "hot-spot" in resistor 10 is of lower temperature and greater dimensions than in conventional thick film resistors.

Tests conducted by the inventor on various resistor types have provided the following results:

| Resistor | Average resistivity drift (in ohms) after the application of 50 volts DC for 15 min. | Average voltage surge capability limit; volts RMS, (183 ms. duration). |
|---|---|---|
| A | 0.78 | 466.0 |
| B | 0.64 | 485.2 |
| C | 0.26 | 512.3 |
| D | 0.17 | 565.2 |

wherein:

Resistor A is a 400 ohm thick film resistor totally on one side of a substrate;

Resistor B is a 400 ohm thick film resistor mounted on both sides of a substrate, and connected so that the current flow in both portions is in the same direction;

Resistor C is the same as resistor B except that the current flow on one side is at right angles to the current flow on the other side; and Resistor D is constructed as resistor 10 of this description.

The inventor also tested the four types of resistors by applying 50 volts DC across them for approximately one minute and obtained the following maximum temperatures:

| | |
|---|---|
| Resistor A | 189° C. |
| Resistor B | 170° C. |
| Resistor C | 159° C. |
| Resistor D | 121° C. |

In particular, with a resistor constructed according to the present invention, the improvements in resistor performance include: improved current surge capability; improved voltage surge capability; and the amount of resistivity drift is reduced.

What is claimed is:

1. A thick film resistor comprising:

an electrically insulating substrate having at least a first face and a second face that are approximately parallel to one another;

a first layer of resistive material deposited on said first face;

a strip of electrically conductive material located on said first face, between said substrate and said first layer, said strip oriented at approximately right angles to the current path through said first layer, said strip situated approximately midway along the current path of said first layer, and said strip being of sufficient length to intercept substantially the whole of the current path through said first layer; and a second layer of resistive material deposited on said second face and connected in series with said first layer in such a fashion that the current path through said second layer is approximately orthogonal to the curent path through said first layer.

2. The resistor of claim 1 wherein said first resistive layer and said second resistive layer each produce approximately one-half the resistance of said thick film resistor.

3. The resistor of claim 1 wherein said substrate is a rectangular parallelepiped.

4. The resistor of claim 2 wherein said substrate is a rectangular parallelepiped.

* * * * *